US007419179B2

(12) United States Patent
Zanco et al.

(10) Patent No.: US 7,419,179 B2
(45) Date of Patent: Sep. 2, 2008

(54) SNOW SKIS

(75) Inventors: Alain Zanco, Guillonnay (FR); Gilles Drevet, Montferrat (FR); Jacky Christoud, Saint Cassin (FR); Benjamin Cuier, Villard de Lans (FR)

(73) Assignee: Skis Rossignol SA, Voiron Cedex (FR)

( * ) Notice: Subject to any disclaimer, the term of this patent is extended or adjusted under 35 U.S.C. 154(b) by 0 days.

(21) Appl. No.: 11/182,924

(22) Filed: Jul. 15, 2005

(65) Prior Publication Data

US 2006/0012150 A1 Jan. 19, 2006

(30) Foreign Application Priority Data

Jul. 15, 2004 (FR) ..... 04 07955

(51) Int. Cl.
*A63C 5/07* (2006.01)

(52) U.S. Cl. ..... 280/602; 280/609

(58) Field of Classification Search ..... 280/601, 280/602, 606, 607, 609, 610, 624, 617, 608
See application file for complete search history.

(56) References Cited

U.S. PATENT DOCUMENTS 5,280,943 A * 1/1994 Commier et al. ..... 280/609
5,393,086 A * 2/1995 Le Masson et al. ..... 280/602
5,397,150 A * 3/1995 Commier et al. ..... 280/607
5,435,588 A * 7/1995 Commier et al. ..... 280/602
5,447,322 A * 9/1995 le Masson et al. ..... 280/602
5,553,884 A * 9/1996 Abondance ..... 280/609
D404,079 S * 1/1999 Borlet ..... D21/766
5,871,223 A 2/1999 Zanco ..... 280/607
5,944,336 A * 8/1999 Fagot ..... 280/607
6,257,612 B1 * 7/2001 Zanco et al. ..... 280/607
6,631,918 B2 * 10/2003 Silva ..... 280/607
6,783,145 B2 * 8/2004 Deborde et al. ..... 280/607
7,011,332 B2 * 3/2006 Zanco ..... 280/602
2003/0234513 A1 12/2003 Zanco ..... 280/602

FOREIGN PATENT DOCUMENTS

FR 2674443 A 10/1992

* cited by examiner

*Primary Examiner*—Hau V Phan
(74) *Attorney, Agent, or Firm*—Fay Sharpe LLP

(57) ABSTRACT

A snow ski board (1) such as a ski, monoski, or a snowboard, with a vertical plane of general symmetry (P) includes a body or base (2) that includes at least in a binding zone (3) two hollow lateral recesses (8*a*, 8*b*) extending longitudinally. A longitudinal rib (11) is defined between the recesses. Each of the longitudinal recesses (8*a*, 8*b*) opens at least towards the top (HA). The body (2) is affixed, at least in the binding zone (3) to a supplementary element (4) having two lateral longitudinal parts (4*a*, 4*b*) which extend longitudinally and parallel. The two lateral longitudinal parts (4*a*, 4*b*) are affixed into the longitudinal recesses (8*a*, 8*b*) and are linked by at least one transverse connector (4*c*).

25 Claims, 12 Drawing Sheets

SNOW SKIS

BACKGROUND OF THE INVENTION

The present application refers to a snow ski board such as a ski, monoski, a snowboard, or the like. It concerns, more particularly, a relative improvement to a ski board base, to which is affixed at least one supplementary element.

Many snow sports have attracted more and more followers and have evolved significantly in recent years with more and more exacting techniques due to the improved quality of the products. Such is the case, for example, with the sport of snow skiing.

Numerous models of skiing boards are known, and more notably skis that are made of a lengthened beam of which the front extremity is raised to define a tip, while the lower surface includes a sliding surface edged by metallic edges.

Despite the efforts of manufacturers to satisfy the clientele, to this day, a ski does not exist which perfectly brings together the comfort of the user and satisfactory control characteristics for whatever the terrain and whoever the user.

SUMMARY OF THE INVENTION

The present application proposes polyvalent skis made of a base and at least one supplementary element whose combined form, dimension, and structure give the body of the ski the desired characteristics for comfort and control.

According to one aspect of the invention a snow ski board such as a ski, a monoski, or a snowboard with a vertical plane of symmetry, has a principal part, called the body or base, including in the shoe or binding zone and at least two hollow lateral receivers or recesses extending longitudinally and defining a longitudinal rib therebetween. Each of the longitudinal receivers opens at least towards the top of the aforementioned body, at least in the binding zone. A supplementary element includes two lateral longitudinal parts which extend longitudinally in a parallel manner. The two lateral longitudinal parts are affixed into the aforementioned hollow receivers. The two lateral longitudinal parts are linked by at least one transverse connector.

According to another embodiment, the two longitudinal lateral parts are linked by two transverse connectors.

According to another aspect, each of the hollow lateral receivers includes two grooves that open to the top of the ski.

According to another aspect, each of the hollow lateral receivers includes two lateral recesses that open laterally towards the exterior and towards the top and do not open towards the bottom, thus forming a lower lateral edge.

Additionally, the thickness of the lower lateral edge of the base as well as the height of the lateral longitudinal parts of the supplementary element is variable.

According to another embodiment, the thickness of the lateral lower edge of the base as well as the height of the lateral longitudinal parts of the supplementary element, diminish progressively from the center of the ski, towards the front and/or towards the back.

According to another embodiment, the thickness of the lower lateral edge of the base is constant, while the height of the lateral longitudinal parts of the supplementary element is variable.

Again, according to another embodiment, the height of the lateral longitudinal parts of the supplementary element diminishes from the center of the ski, towards the front and/or back.

According to another embodiment, the thickness of the lower lateral edge of the base varies, while the height of the lateral longitudinal parts of the supplementary element is constant.

Additionally, the thickness of the lateral edge of the base can be constant or can diminish from the center of the ski towards the front and/or towards the back.

According to another embodiment, the height of either of the lateral longitudinal parts of the supplementary element is equal to or higher than the height of the corresponding recesses.

Also note that the base has its own thickness distribution, width, and stiffness.

According to another embodiment, the width of the lateral recesses is longitudinally variable, being wider at the center of the ski, and diminishing towards the front and/or towards the back.

Additionally, the longitudinal parts of the supplementary element includes elongated profiles, the transverse section of which progressively changes in its dimensions and/or in its form.

Thus, the width of the longitudinal lateral part of the supplementary element can be longitudinally variable, being wider at the center of the ski, and diminishing towards the front and/or towards the back.

According to another embodiment, the length of the lateral longitudinal part of the supplementary element is slightly higher than the height of the corresponding recess.

According to another embodiment, the supplementary element has a hollow profile made of composite material and is made through thermoforming or hot forming of a composite material sheet.

According to another embodiment, one base corresponds to a set of several different supplementary elements.

Still further advantages of the present invention will be appreciated to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 10' is a cross-section of a ski, with supplemental elements attached;

FIGS. 15 and 16 are analogous views to FIGS. 3 and 4, while FIG. 17 is an analogous view to FIG. 6D;

DETAILED DESCRIPTION OF THE PREFERRED EMBODIMENTS

Figure 1:
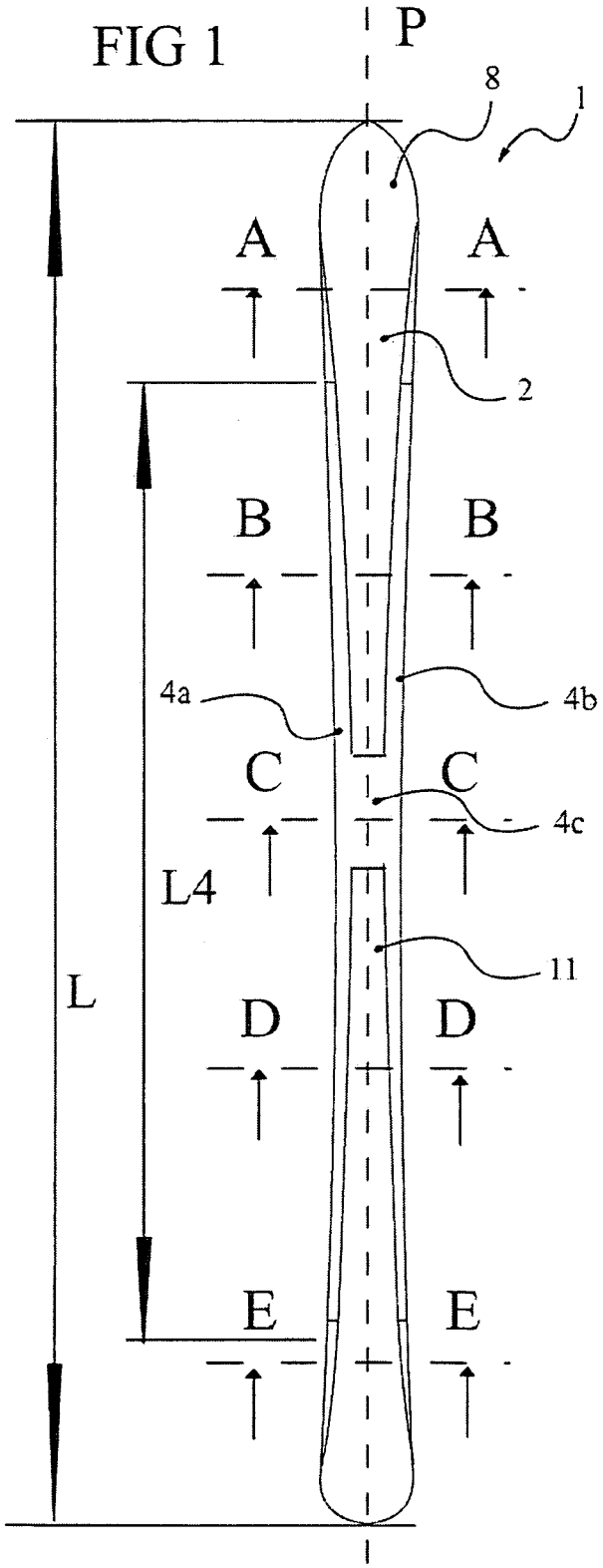
FIG. 1 is a top view of a ski, including a base and a supplementary element.
Figure 2:
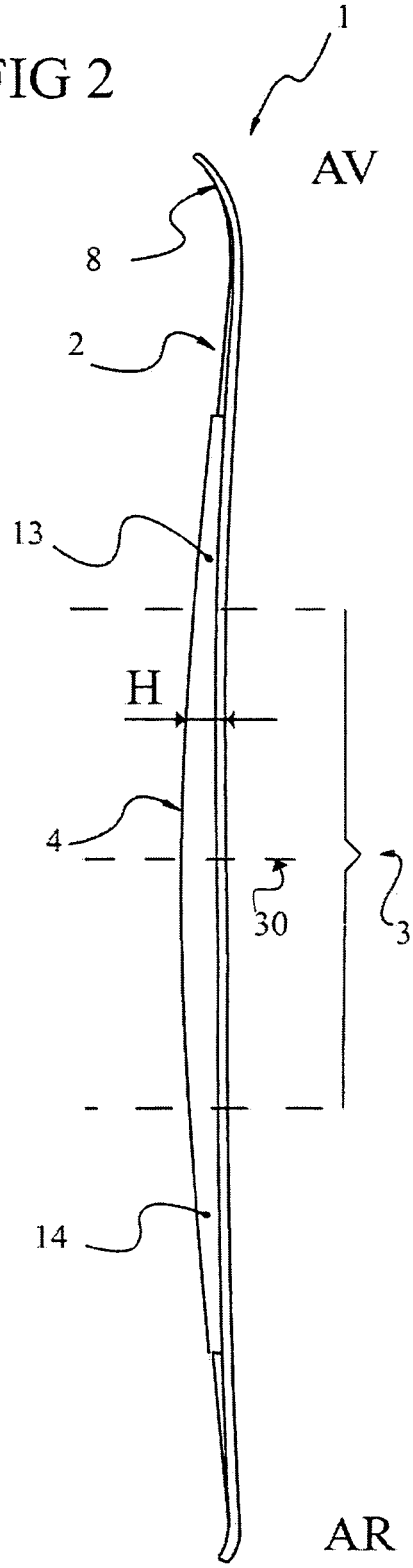
FIG. 2 is a side view of the ski, including the base and the supplementary element.
Figure 3:
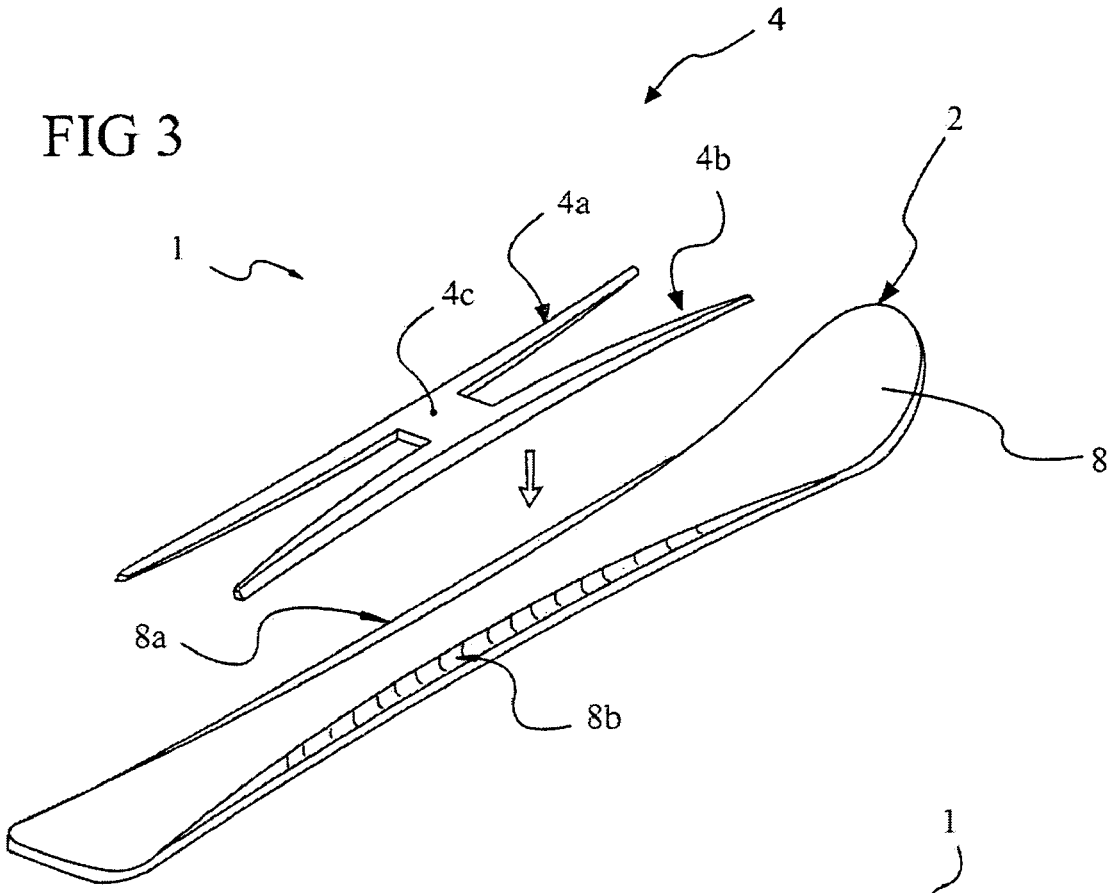
FIG. 3 is a perspective view of the base illustrating the placement of the supplementary element.
Figure 4:
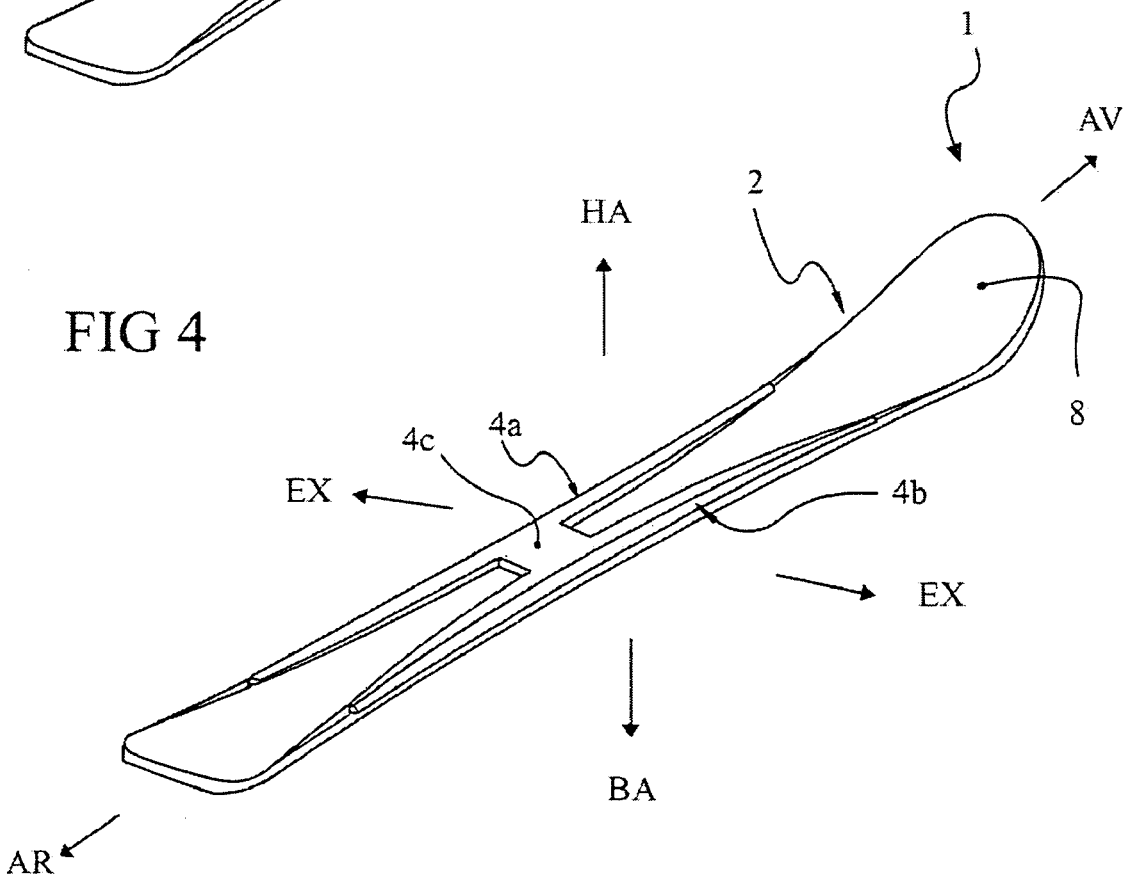
FIG. 4 is a perspective view of the ski including the base and the received supplementary element.
Figure 5A:
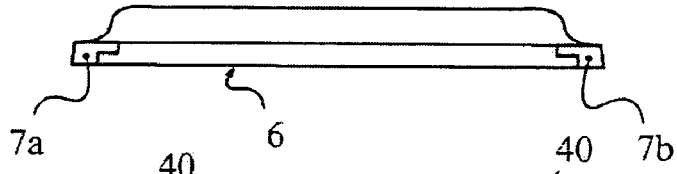
FIGS. 5A, 5B, 5C, 5D, and 5E are cross-sectional views along lines A-A, B-B, C-C, D-D, and E-E of FIG. 1 illustrating receipt of the supplementary element.
Figure 5B:
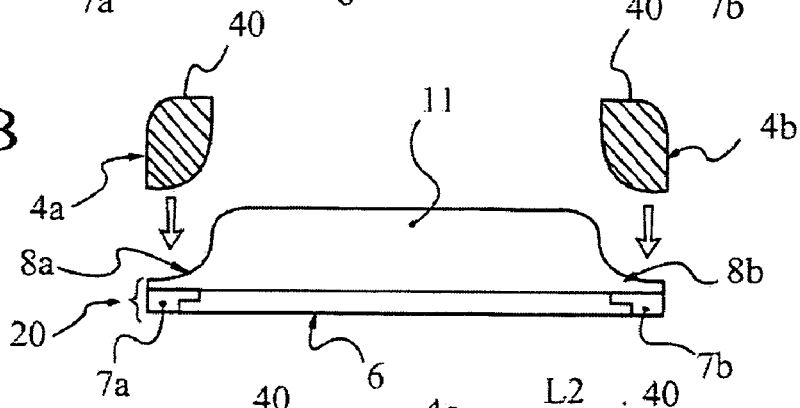
Figure 5C:
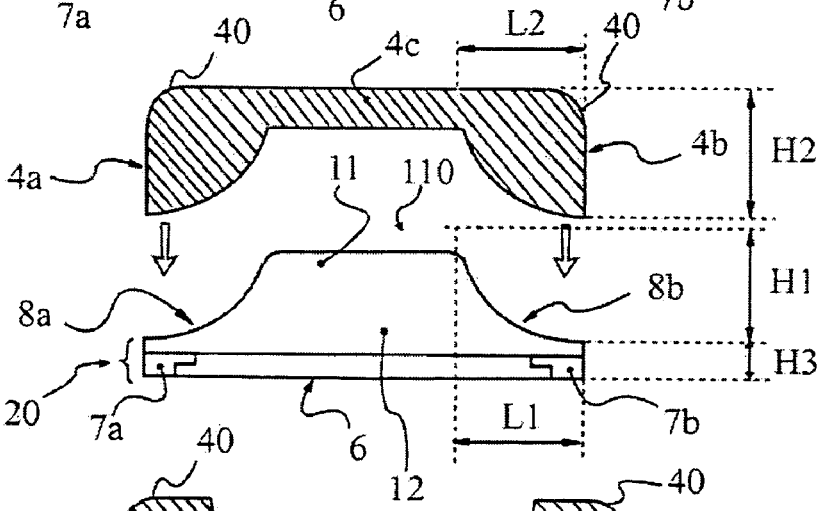
Figure 5D:
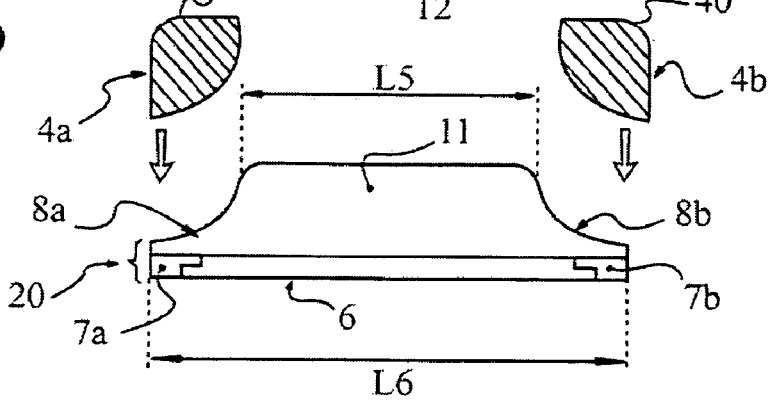
Figure 5E:
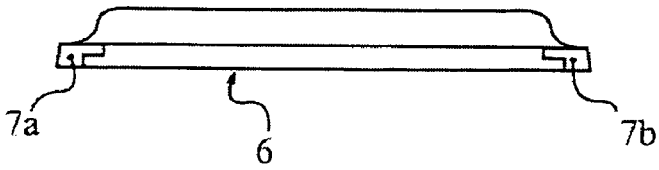
Figure 6A:
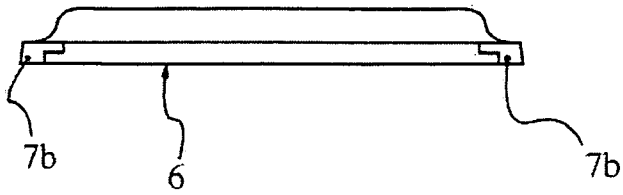
FIGS. 6A, 6B, 6C, 6D, and 6E are cross-sectional views along A-A, B-B, C-C, D-D, and E-E of the ski, with its supplementary element attached onto the base.
Figure 6B:
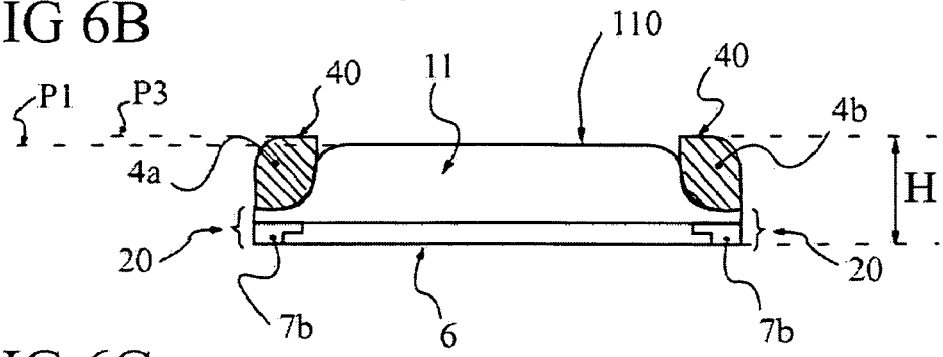
Figure 6C:
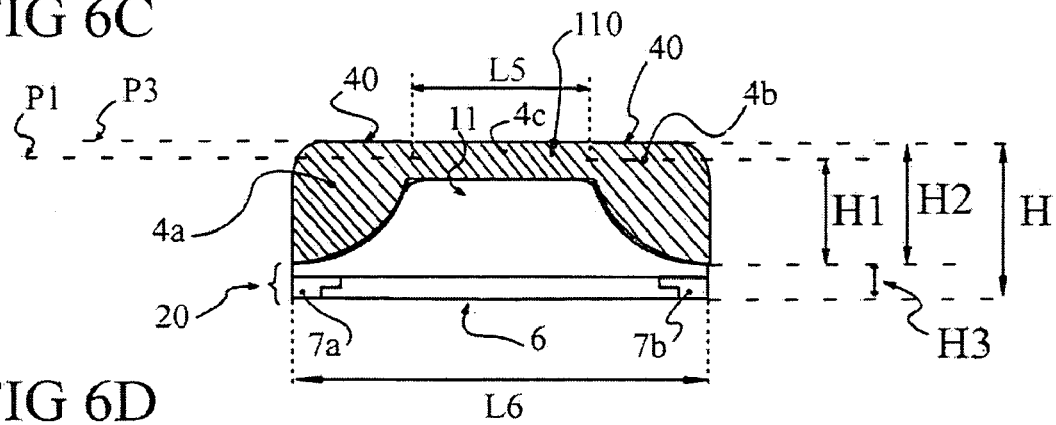
Figure 6D:
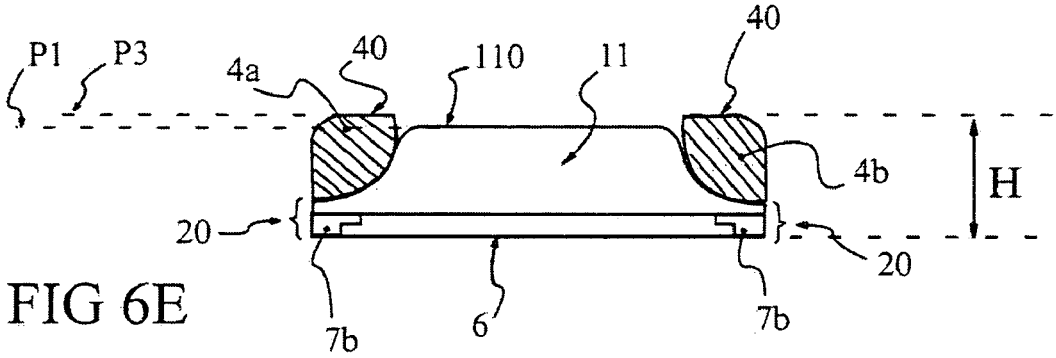
Figure 6E:
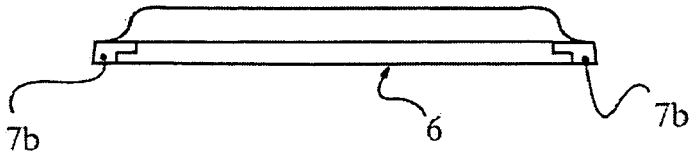

The ski 1 is an assembly of elongated forms with vertical plane P of general symmetry. A front of the ski is raised to form a tip 8.

The ski 1 is made of a principal part, e.g., a body or base 2 to which at least one supplementary element 4 is affixed, at least in a zone 3 for mounting bindings.

The base 2 is the element in contact with the snow and has the form of an elongated beam with a sliding sole or surface 6 on its lower surface bordered on the edges by lateral metal edges 7*a*, 7*b*.

The base 2 is an elongated beam of which the front extremity is raised to constitute the tip 8 of the ski. The base 2 has its own thickness distribution, rib line, width, and stiffness and can be made of all types of materials.

Thus, the elongated beam includes the base 2 which can be made of many types of conceptions, for example, the laminate type, the chamber type, or the core type, or even the type associating the shell and lateral strips, taken alone or in combination, indeed mixed and constituting an assembly of known elements and of components.

Figure 10:
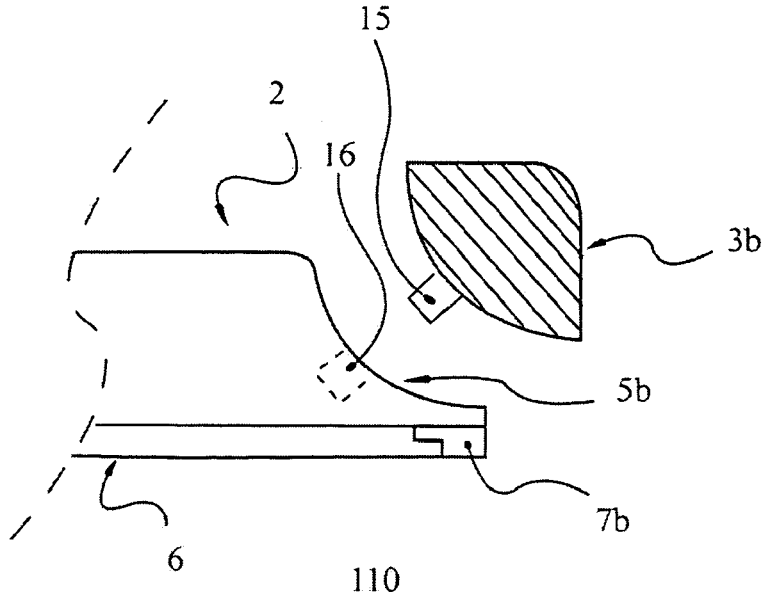
FIG. 10 is a cross-sectional view, showing the attachment of the supplementary element and the base.
Figure 10:
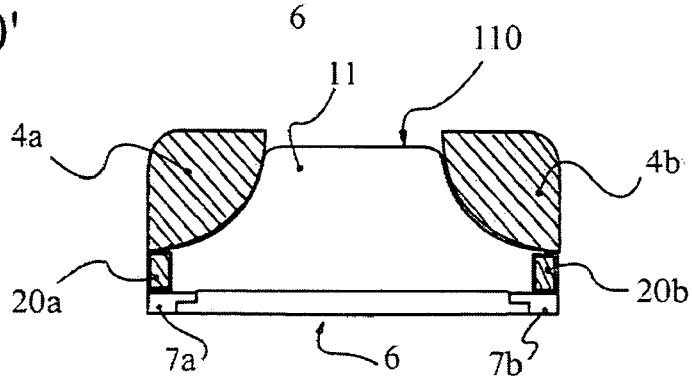

FIG. 10' is a cross-section of a ski associating a shell and lateral strips 20*a*, 20*b*.

A supplementary element 4 is meant to stop the bending of the ski and acts as a stiffener.

Thus, according to the preferred embodiment, the supplementary element 4, in the general form of an "H", includes two longitudinal lateral parts 4*a*, 4*b* which spread longitudinally, and which are linked by a transverse connecting part 4*c* which extends transversely, in a median zone of the supplementary element.

Figure 14:
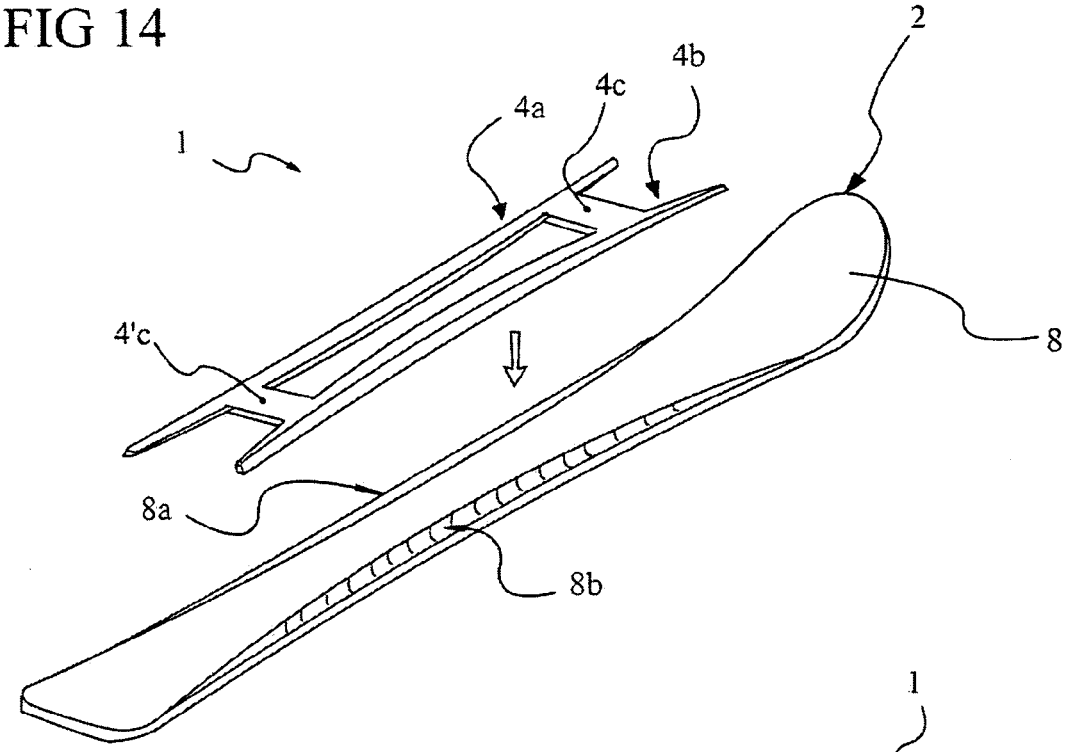
FIGS. 14 and 14*a* are views analogous to FIGS. 3 and 4, respectively, showing a variation of the embodiment according to which the two longitudinal lateral parts of the supplementary element are linked by two transverse connecting parts.
Figure 14A:
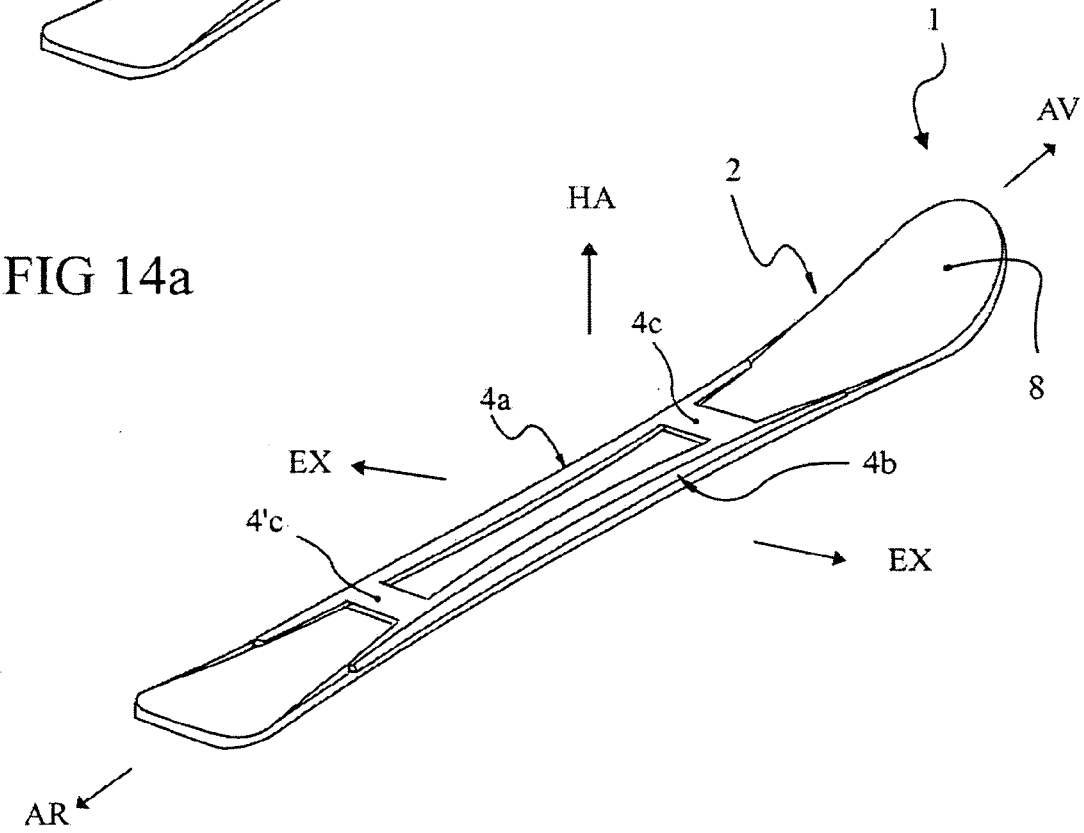

Alternately, the supplementary element 4 could include two transverse connecting parts 4*c*, 4'*c* which link the two longitudinal lateral parts 4*a*, 4*b* such as illustrated in FIGS. 14 and 14*a*. Thus, the supplementary element 4 variation includes a front connecting part 4*c* and a rear connecting part 4'*c*.

The two longitudinal lateral parts 4*a*, 4*b* are made by lengthened profiles, whose transverse section tapers in its dimensions and/or in its form.

Figure 18:
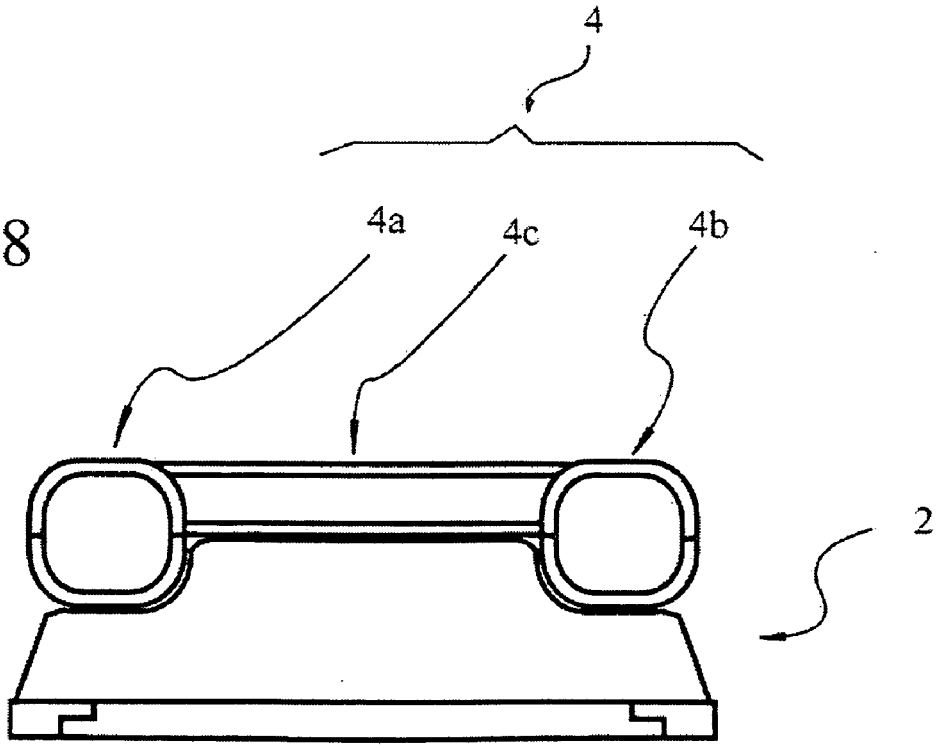
FIG. 18 is an analogous view to FIG. 6D, showing another embodiment of the supplementary element; and, FIGS. 19, 19*a*, 19*b*, and 19*c* are views illustrating an embodiment of a procedure for making the supplementary element.

Like the base 2, each of the lateral longitudinal parts 4*a*, 4*b* has its own configuration, structure, thickness distribution, width, and stiffness and can be of all types of construction. Thus, the supplementary element 4, with its two longitudinal lateral parts 4*a*, 4*b* can be formed by a solid element made of the same material. But it can be of a different construction, for example, formed by having the form of a tube including an external portion, for example, in composite material, of which the central part could be empty or filled with a filling material, such as synthetic foam, as illustrated in FIG. 18. In this case, the supplementary element is, for example, manufactured by thermoforming or hot forming.

In a preferred embodiment given as an example, the profile of each of the lateral longitudinal parts 4*a*, 4*b* diminishes in width and in thickness in a progressive manner from a central zone 30 towards the front AV and towards the back AR.

According to one characteristic, the base 2 includes lateral recesses or receivers 8*a*, 8*b* into each one of the longitudinal lateral parts 4*a*, 4*b* is received and affixed. Thus, the base 2 includes a left lateral recess 8*a* into which is affixed the left lateral longitudinal part 4*a* and a right lateral recess 8*b* into which is affixed the right lateral longitudinal part 4*b*.

Each of the lateral recesses is in a partially complementary shape form to receive the corresponding lateral longitudinal part 4*a*, 4*b*.

Specifically, each of the lateral recesses 8*a*, 8*b* opens laterally towards the exterior one EX and towards the top HA while it does not open towards the bottom BA. The two lateral recesses 8*a*, 8*b* are destined to receive the longitudinal lateral parts 4*a*, 4*b* of the supplementary element 4.

Note that, advantageously, the width L1 of the recesses varies longitudinally, becoming wider at the center 30 of the ski 1, and diminishing progressively, towards the front AV or towards the back AR and towards the front AV and towards the back AR.

Similarly, the height H1 of the recess 8*a*, 8*b* varies longitudinally, becoming higher at the center of the ski, and diminishing progressively, towards the front AV or towards the back AR, and towards the front AV and towards the back AR.

According to a preferred embodiment, the height H2 of the profile of the two longitudinal lateral parts 4*a*, 4*b* is higher than the height H1 of the corresponding recesses 8*a*, 8*b* on all or part of the length of the lateral longitudinal parts of the supplementary element. But, according to this preferred embodiment, the height H2 of the profile of the two longitudinal lateral parts 4*a*, 4*b* is higher than the height H1 of the corresponding recesses 8*a*, 8*b*.

Thus, the general plane P3 of an upper surface 40 of the longitudinal lateral parts 4*a*, 4*b* is situated above the plane P1 of an upper surface 110 of a longitudinal rib 11.

The height H2 of the profile of each of the lateral longitudinal parts 4*a*, 4*b* of the supplementary element 4 could be equal to the height H1 of the corresponding recesses or receivers 8*a*, 8*b* along the whole length of the supplementary element. Thus, the general plane P3 of the upper surface 40 of the lateral longitudinal parts 4*a*, 4*b* would be situated in the same general plane P1 as the upper surface 110 of the longitudinal rib 11.

One therefore has to understand that the height H2 of the profile of at least one of the lateral longitudinal parts 4*a*, 4*b* of the supplementary element 4 can be equal to or higher than the height H1 of the corresponding recess 8*a*, 8*b*.

Besides the width L2 of the lateral longitudinal parts 4*a*, 4*b* of the supplementary element 4 varies longitudinally, becoming wider at the center 30 of the ski 1, and diminishing towards the front AV or towards the back AR. While their height H2 varies longitudinally towards the front AV and towards the back AR to be more prominent at the center 30 of the ski and diminish towards the front AV and towards the back AR.

One will add that the height H, the thickness of the ski 1, i.e., the height of the base 2 plus the height of the lateral longitudinal parts 4*a*, 4*b* is equal to the distance between the upper surface 40 of the lateral longitudinal parts 4*a*, 4*b* and the lower sliding surface 6. Thus, the height H corresponds to the thickness of the ski 1 at the level of the longitudinal lateral parts 4*a*, 4*b* which is equal to the height H2 of the aforementioned parts plus the thickness H3 of the lateral edge 20 of the base 2.

One will note that the height H is variable and progressively diminishes towards the front AV or towards the rear AR, and towards the front AF and towards the back AR.

The height variation H can be obtained in different manners, such as:

- a lateral edge 20 of the base 2 is of a varying thickness H3, which diminishes progressively from the center 30 of the ski 1 towards the front and towards the back, while the height H2 of the lateral longitudinal parts 4*a*, 4*b* also varies and progressively diminishes from the center of the ski towards the front and towards the back;
- a lateral edge 20 of the base 2 is of a constant thickness H3, while the height H2 of the lateral longitudinal parts 4*a*, 4*b* varies and progressively diminishes from the center of the ski towards the front and towards the back;
- a lateral edge 20 of the base 2 is of a varying thickness H13 diminishes from the center of the ski towards the front and towards the back, while the height H2 of the lateral longitudinal parts 4*a*, 4*b* is constant.

By way of example, one will note that the overall length L4 of the supplementary element 4 and notably of its lateral longitudinal parts 4*a*, 4*b* can exted to all or part of the length of the base. It can be, for example, equal to or longer than 30% of the length L of the base 2, for example, being between 30% and 90%. Thus, the length L4 of the supplementary element can be of, for example, a length between 50 and 150 centimeters for a ski with a length of 170 centimeters.

Note that the two longitudinal parts 4*a*, 4*b* of the supplementary element 4 can have the same length or can have different lengths. Thus, the length of one of the longitudinal parts 4*a* or 4*b* can be longer than the other longitudinal part 4*b* or 4*a*.

The form of the transverse section of each of the elements can be as illustrated, but can also be round, square, rectangular, or the like. Also, note that the form of the section can vary longitudinally.

According to a supplementary characteristic, the base 2 can correspond to an ensemble of several supplementary elements 4, 4', 4".

Figure 7:
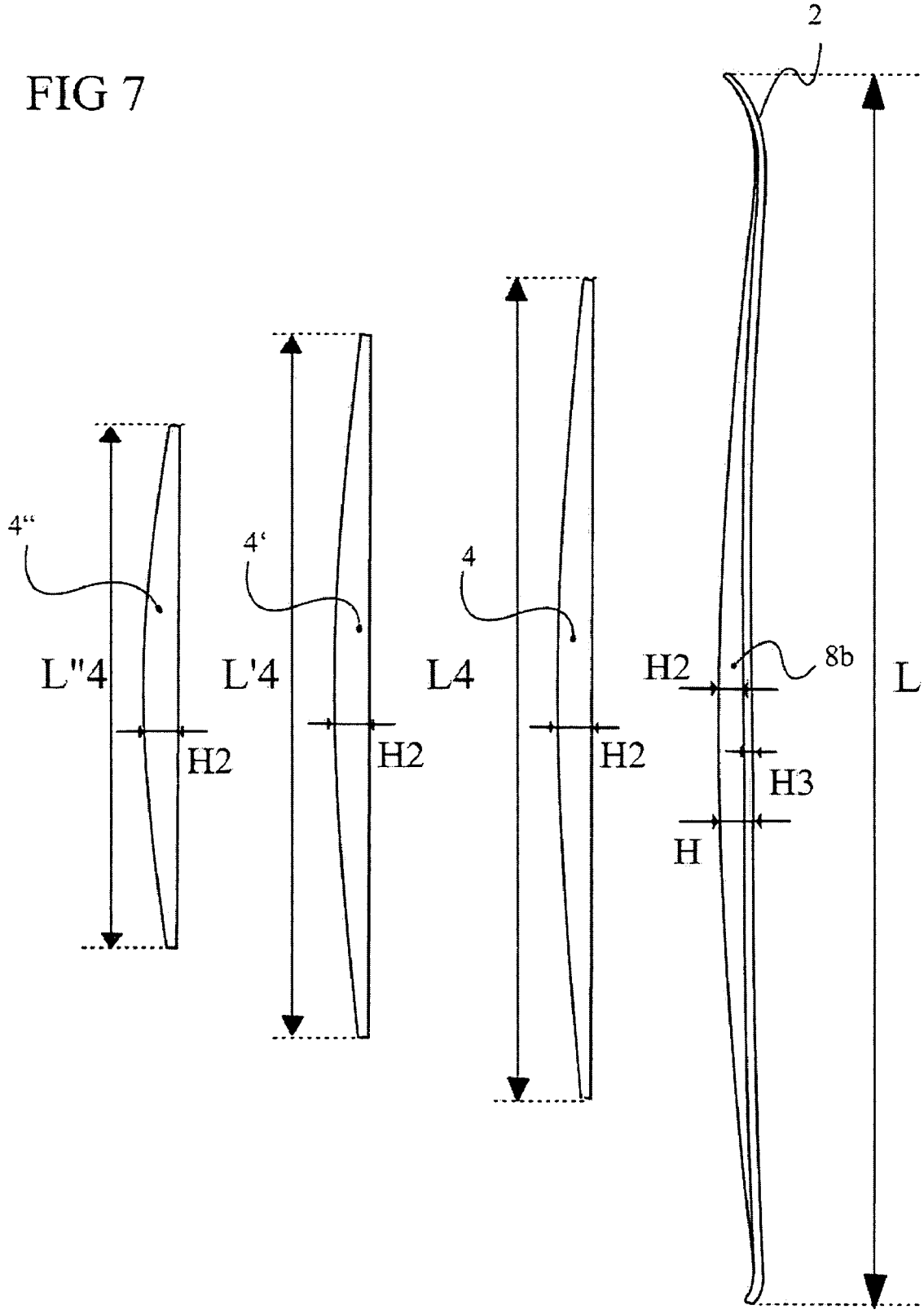
FIG. 7 is a lateral view of another embodiment according to which a base has several corresponding supplementary elements.

Thus, a given base 2 can correspond to several supplementary elements of different lengths L4, L'4, L"4 and, for example, three supplementary elements of different lengths, such as illustrated in FIG. 7. Similarly, a given base 2 can correspond to several supplementary elements of different thicknesses. Also, note that a given base 2 can correspond to several supplementary elements of different mechanical characteristics, giving the ski 1, constituted by the base 2 and its supplementary element 4, characteristics for different behaviors, handling and control. The different characteristics can be obtained by different thicknesses of the supplementary elements, or by a different structure, indeed different materials, also by a different geometry.

Figure 8:
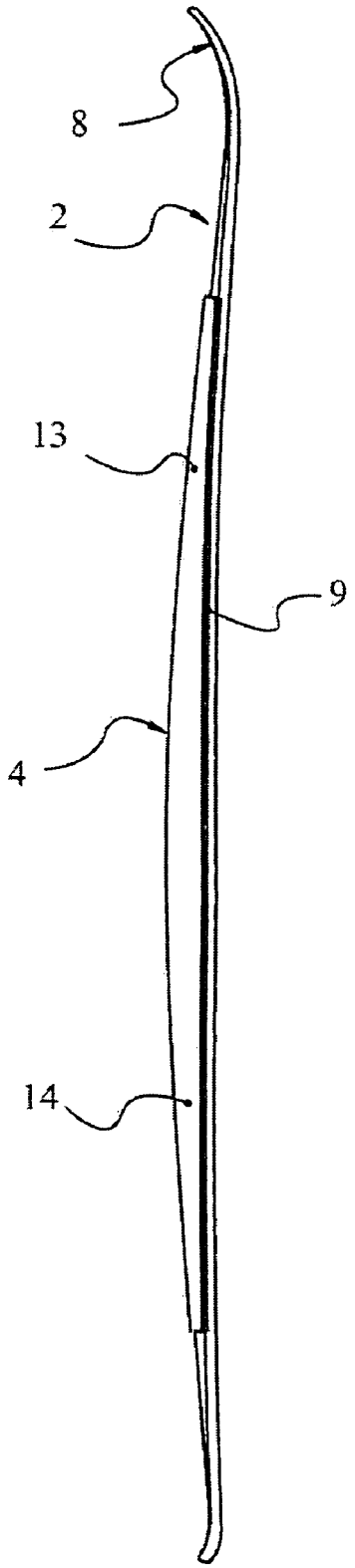
FIG. 8 shows, in a side view, how the two lateral longitudinal parts of the supplementary element can be mounted on the base.
Figure 9:
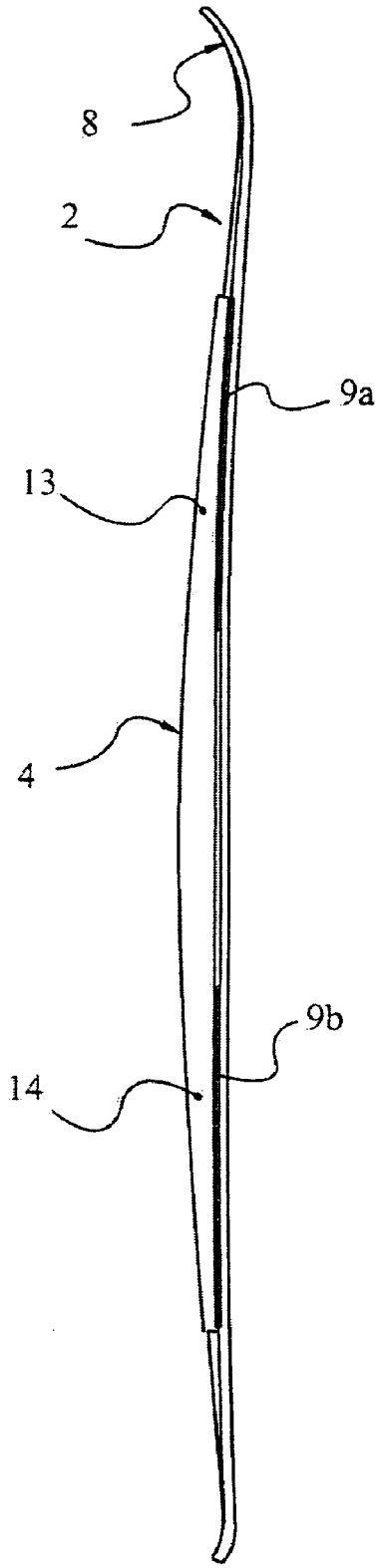
FIG. 9 shows a variation of the embodiment of FIG. 8.

The affixing of the supplementary element 4 onto the base 2 is done by putting it in place and affixing into the corresponding recess 8*a*, 8*b*. This joint may be made, for example, by gluing or welding. This joint 9 can be done on the whole surface of the supplementary element 4 with the recess, as is illustrated in FIG. 8 or this joint 9*a*, 9*b* can be done on only a part of the surface as, for example, in frontal 13 and rear 14 zones, such as shown in FIG. 9.

One could see that the joining of the supplementary element 4 to the base 2 can be done mechanically as, for example, by embedding a projection 15 into corresponding holes 16, such as shown in FIG. 10.

Figure 11:
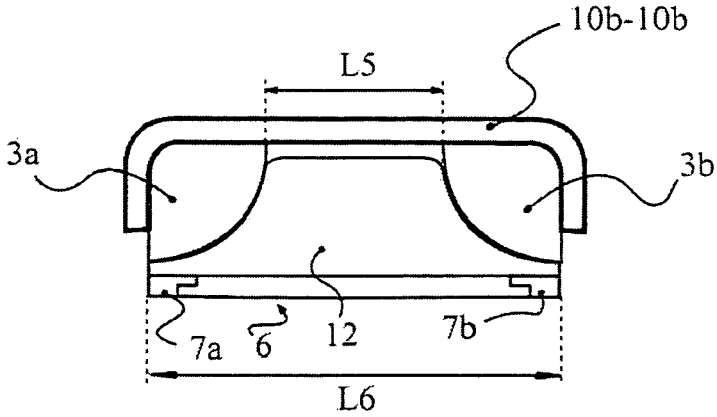
FIGS. 11 and 12 show an embodiment according to which the bindings are attached on a stirrup attached at the longitudinal lateral parts of the supplementary element.
Figure 12:
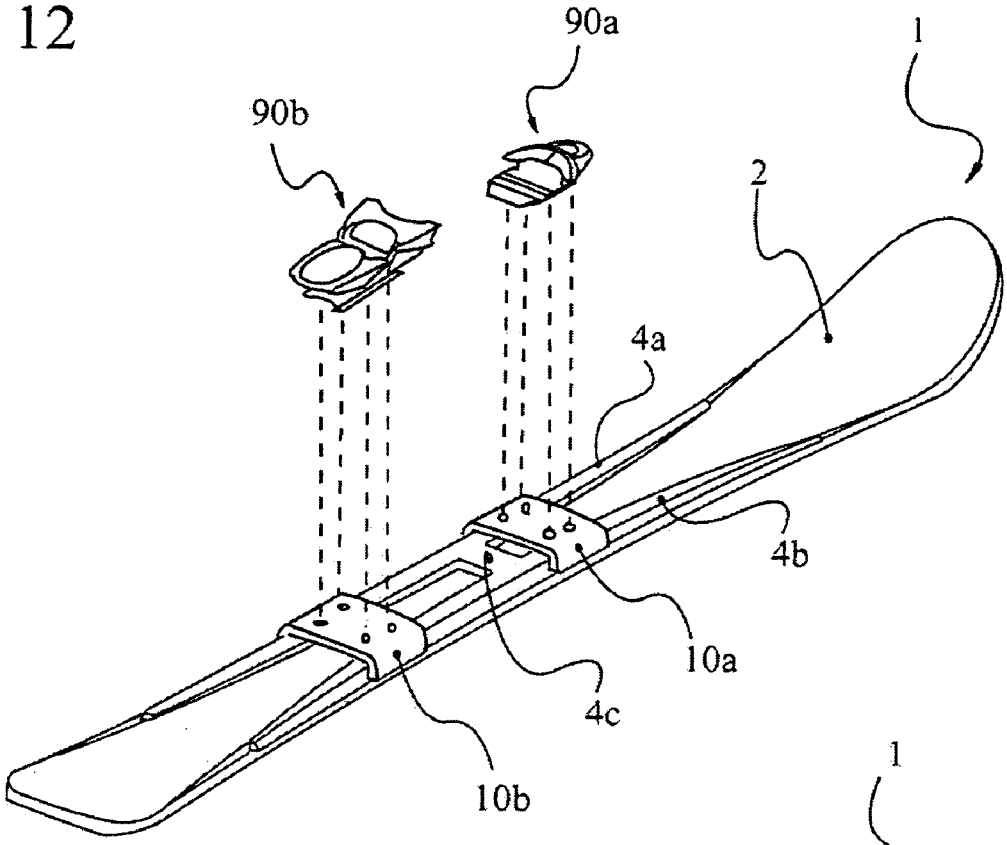

FIGS. 11 and 12 illustrate how the ski bindings 90*a*, 90*b* can be set up. The bindings are to hold the boot of the skier. To this effect, it is, for example, foreseen as two clamps or stirrups, front 10*a* and rear 10*b*, on which the bindings 90*a*, 90*b* are attached, the aforementioned clamps being affixed on the supplementary lateral elements. Note that the clamp can be affixed to the lateral supplementary elements 3*a*, 3*b* by any known means, such as glue, screws, etc . . . .

The transverse part of the connector 4*c* also can serve as a platform on which the bindings 90*a*, 90*b* are to be mounted and are then be of sufficient length.

Instead of attaching the bindings 90*a*, 90*b*, the previously described clamps or stirrups can be attached to the longitudinal lateral parts 4*a*, 4*b* of the supplementary element 4 or onto the base 2.

Figure 13:
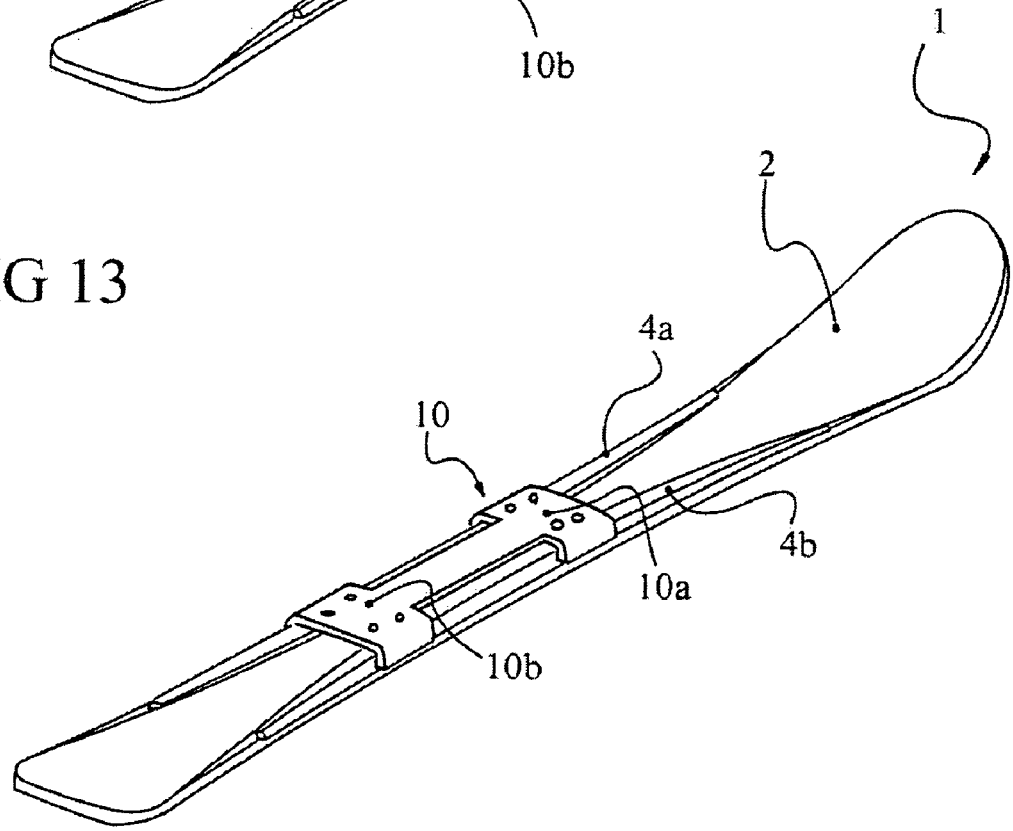
FIG. 13 is a similar view to that of FIG. 12, illustrating a variation without the bindings.

FIG. 13 is a view similar to FIG. 12, but shows a different execution in which the two stirrups 10*a*, 10*b* are linked to form a single stirrup 10. In the zone occupied by the longitudinal lateral parts, the base 2 includes a longitudinal rib 11 bordered by the two lateral recesses 8*a*, 8*b* the width L5 of which is smaller than the width L6 of the lower part 12 of the aforementioned base 2. Each of the lateral recesses is therefore limited in the plane of symmetry P by the longitudinal rib 11 and at the bottom by the lower part 12 of the base which includes the metal edges 7*a*, 7*b* and the sliding surface 6.

Adding that as the ski 1 can be such that the left lateral longitudinal part 4*a* is different than the right lateral longitudinal part 4*b* in length, as was already said, but also in its section, its transverse dimensions, its construction characteristics, and even its technical characteristics.

It is obvious that the previously mentioned variations can advantageously be progressive. But, it is obvious that the variations can be realized in successive steps, with or without discontinuities.

The upper surface 40 of one of the lateral longitudinal parts is not necessarily the same height as the upper surface 40 of the other lateral longitudinal part.

Figure 15:
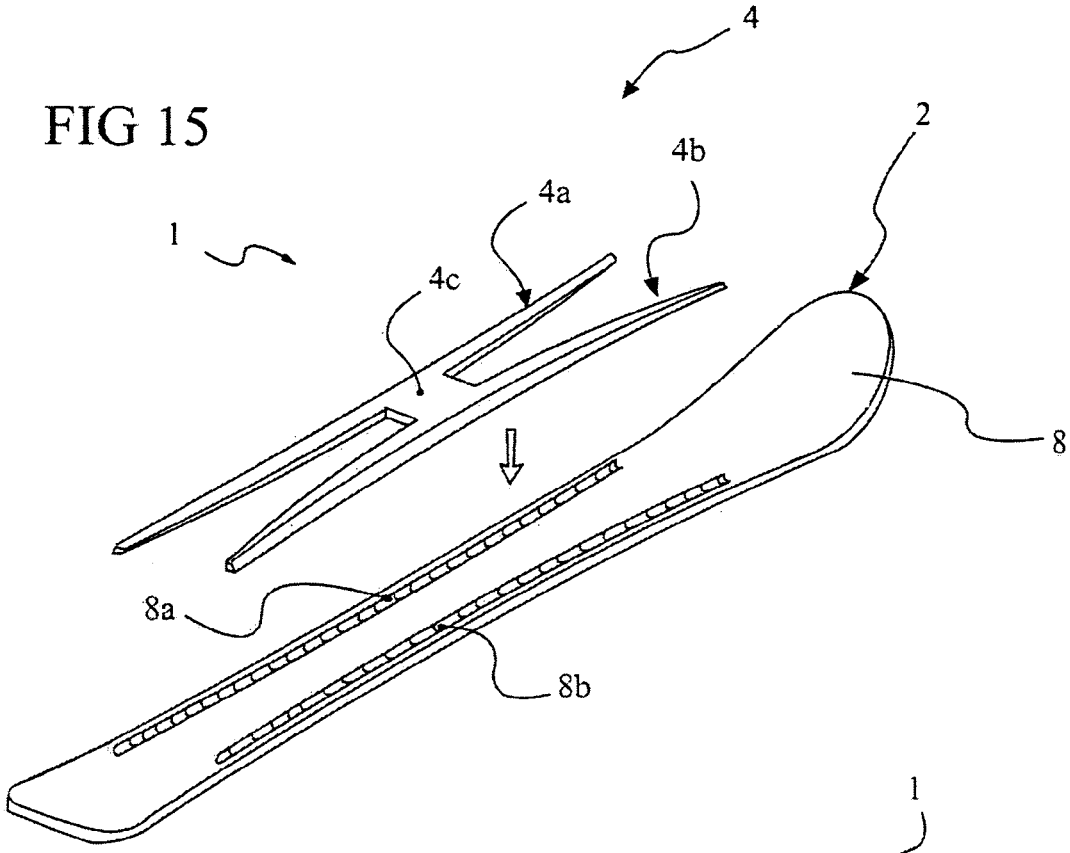
FIGS. 15, 16, and 17 are views showing another embodiment.
Figure 16:
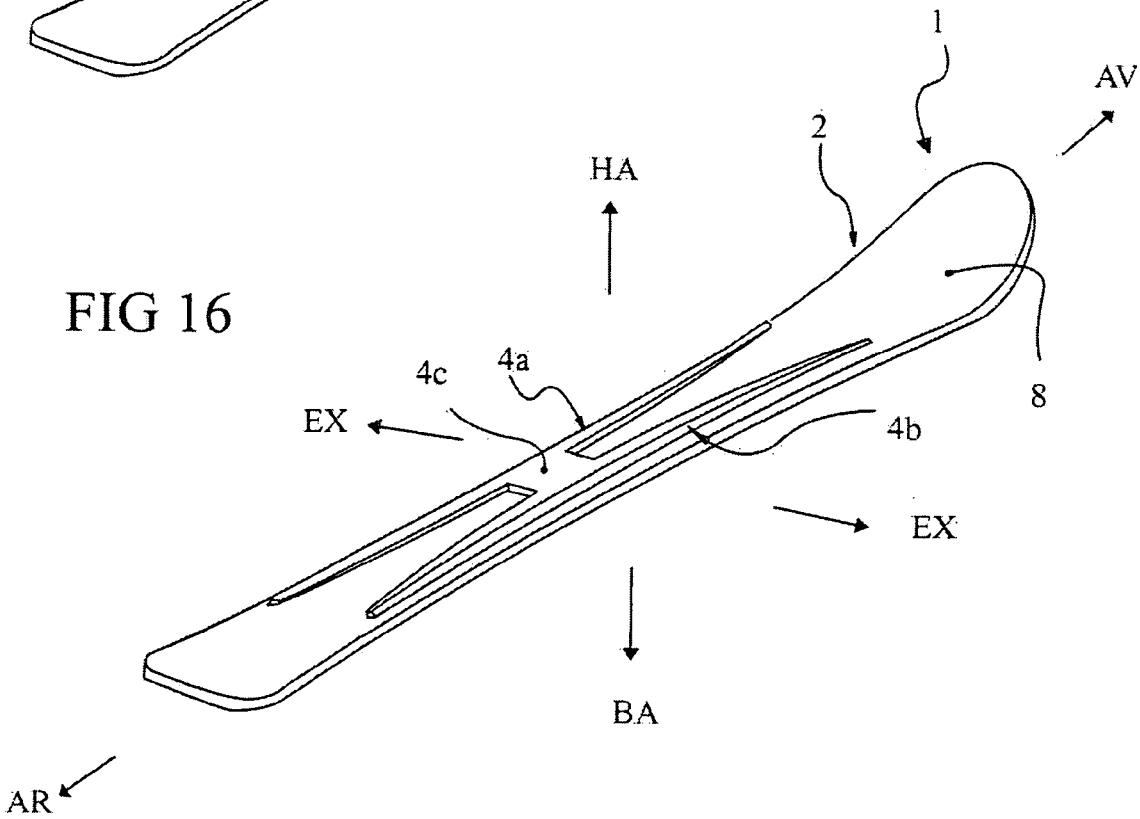
Figure 17:
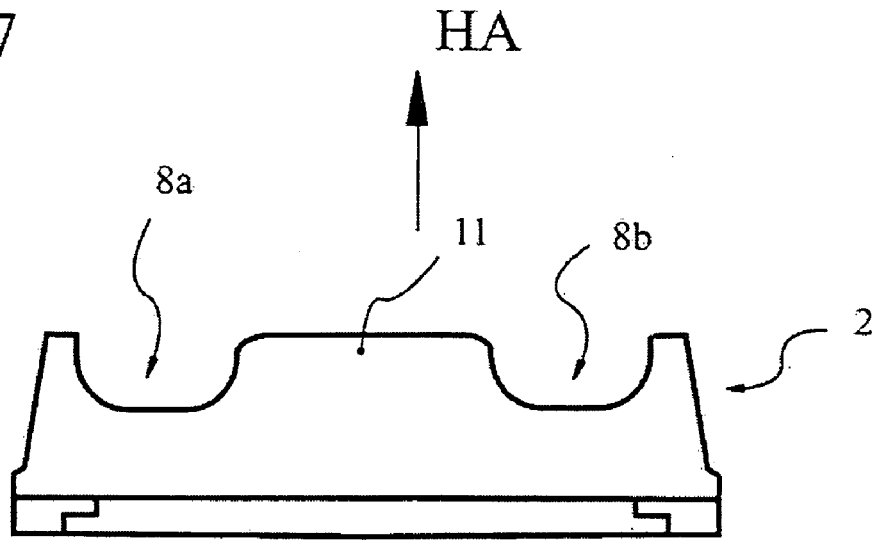

According to the embodiment previously described, the two hollow lateral receivers 8*a*, 8*b* extend longitudinally and opens towards the top and laterally to constitute two lateral recesses. But, it can be otherwise without leaving the realm of the invention. In fact, these two lateral receivers destined to receive the longitudinal lateral parts of the supplementary element could be two lateral grooves such as illustrated in FIGS. 15, 16, and 17.

The supplementary element forms the stiffener for the base 2 and can, as we said previously, be made in sheets or layers of composite material.

Figure 19:
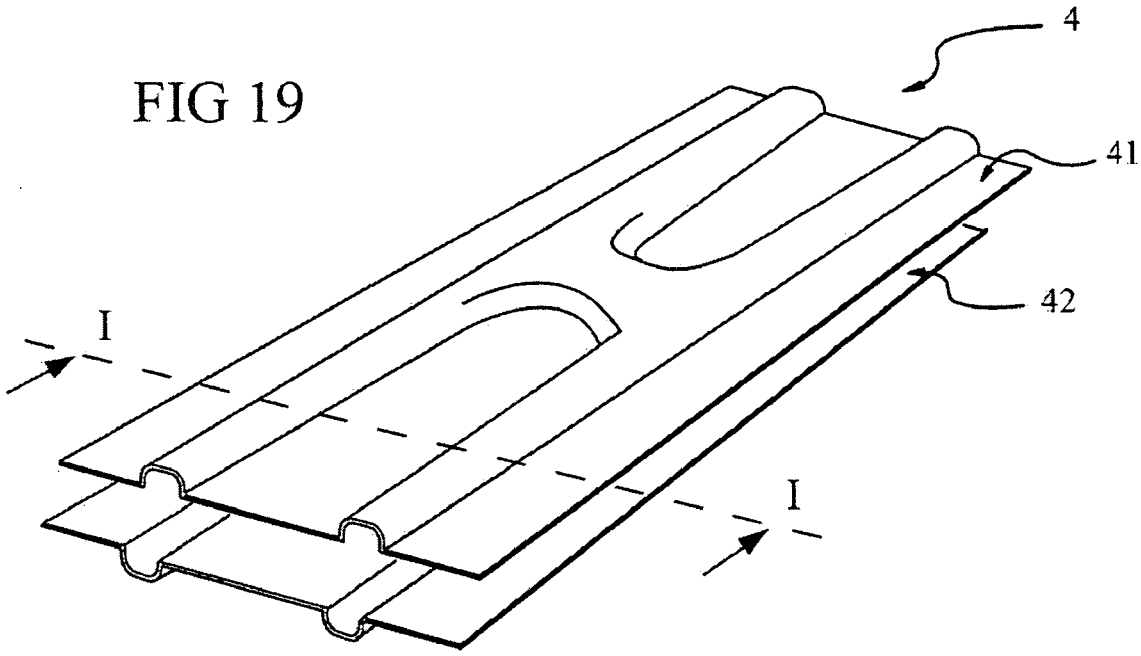
Figure 19A:
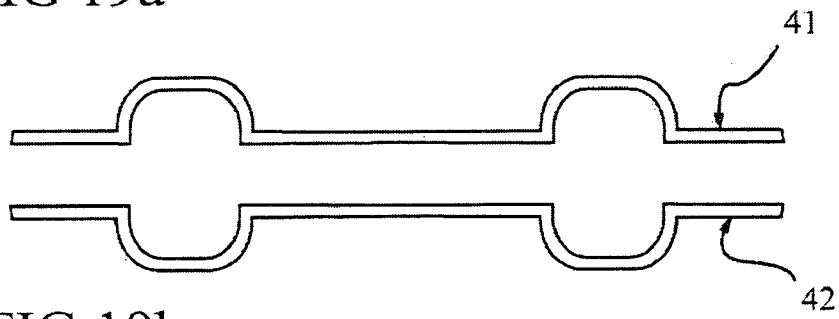
Figure 19B:
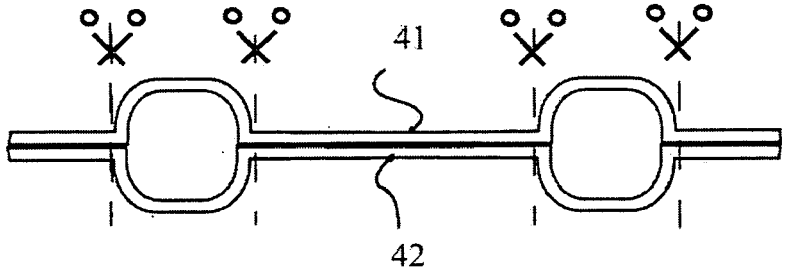
Figure 19C:
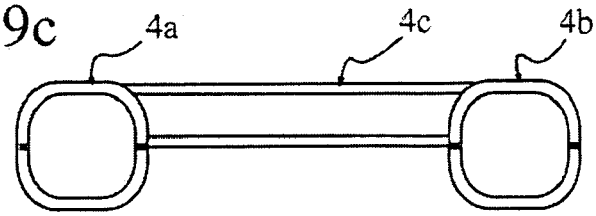

FIGS. 19, 19*a*, 19*b*, 19*c* illustrate a possible embodiment of the supplementary element 4. According to the following procedure:

- it is made of two halves 41, 42 by forming or thermoforming a layer of composite material (FIG. 19*a*);
- the two halves 41, 42 are then assembled by gluing or welding;
- the assembly obtained in the preceding step is next trimmed (FIG. 19*b*) to obtain the supplementary element illustrated in FIG. 19*c*.

Also, note as the transverse connecting part 4*c*, according to the illustrations given in the examples, can attach to the surface 110 of the central rib 11. But, it can be otherwise, as for example, it can be lodged in a transverse groove in the longitudinal rib 11 of the base.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

Having thus described the preferred embodiments, the invention is now claimed to be:

1. A snow ski board with a vertical plane of general symmetry having:

a base including at least in a binding zone, two hollow lateral receivers extending longitudinally along the base to define a longitudinal rib therebetween, each of the longitudinal receivers opening at least upward, a supplementary element including two longitudinal lateral parts extending longitudinally in a parallel manner, the two longitudinal lateral parts being set in the aforementioned hollow receivers, the longitudinal lateral parts extend beyond a central zone for mounting of bindings toward a forward part and a rear part of the base, the two lateral longitudinal parts being linked by at least one transverse connecting part, the two longitudinal lateral parts and the connecting part of the supplemental element being an integral piece forming by a solid element made of the same material.

2. The snow ski board according to claim 1, wherein the two longitudinal lateral parts are linked by two integral transverse connecting parts.

3. The snow ski board according to claim 1 wherein each of the hollow lateral receivers includes a groove that opens towards the top.

4. The snow ski board according to claim 1 wherein each of the hollow lateral receivers includes two lateral recesses that open laterally toward a side and top and not towards a bottom of the base such that the base forms a lower lateral edge below the recess.

5. The snow ski board according to claim 4 wherein a thickness of the lower lateral edge of the base and a height of the lateral longitudinal parts of the supplementary element both vary.

6. The snow ski board according to claim 5 wherein the thickness of the lower lateral edge of the base and the height of the lateral longitudinal parts of the supplementary element diminish from a center of the base towards at least one of the front and back.

7. The snow ski board according to claim 5 wherein at least one of the thickness of the lower lateral edge of the base and the height of the lateral longitudinal parts of the supplementary element diminish progressively from a center of the base towards at least one of the front and back.

8. The snow ski board according to claim 7 wherein a height of each of the lateral longitudinal parts of the supplementary element is higher than a height of a corresponding one of the receivers.

9. The snow ski board according to claim 4 wherein a thickness of the lower lateral edge of the base is constant and a height of the lateral longitudinal part of the supplementary element vary.

10. The snow ski board according to claim 9 wherein the height of the lateral longitudinal parts of the supplementary element diminishes from a center of the base towards at least one of the front and back.

11. The snow ski according to claim 10 wherein the height of the lateral longitudinal parts of the supplementary element diminishes progressively from the center of the base towards both the front and towards the back.

12. The snow ski according to claim 4 wherein a thickness of the lower lateral edge of the base varies while a height of the lateral longitudinal parts of the supplementary element is constant.

13. The snow ski board according to claim 12 wherein the thickness of the lateral edge of the base diminishes from a center of the base towards at least one of the front and back.

14. The snow ski board according to claim 13 wherein the thickness of the lateral edge of the base diminishes progressively from the center of the base towards the front and towards the back.

15. The snow ski board according to claim 1 wherein a height of at least one of the lateral longitudinal parts of the supplementary element is equal to or higher than a height of a corresponding one of the receivers.

16. The snow ski board according to claim 1 wherein the base has a thickness distribution, rib line, width, and stiffness.

17. The snow ski board according to claim 16 wherein a width of the lateral receivers varies longitudinally, being larger at a center of the base and diminishing towards at least one of the front and back.

18. The snow ski board according to claim 1 wherein at least one of the lateral longitudinal parts of the supplementary element have a transverse section that progressively changes in at least one of dimension and form.

19. The snow ski board according to claim 1 wherein a width of the lateral longitudinal parts of the supplementary element varies longitudinally, being wider at a center of the base and diminishing towards at least one of the front and back.

20. The snow ski board according to claim 1 wherein a length of the lateral longitudinal parts of the supplementary element is equal to or greater than 30% of a length of the base.

21. The snow ski board according to claim 1, wherein the supplementary element is hollow and constructed of a composite material.

22. The snow ski board according to claim 1 further including:

a set of several supplementary elements with different characteristics, the supplemental elements being H-shaped and being interchangeably attached to the base to alter skiing characteristics, each H-shaped supplemental element being interchanged as a unit.

23. The snow ski board according to claim 1 wherein the supplementary element is made by thermoforming or hot forming of a composite material.

24. A supplemental element according to claim 23 for interconnection with a ski base.

25. The snow ski board according to claim 1, further including:

at least one binding mounting structure different from the integral connecting part for receiving bindings, the binding mounting structure being wider than the rib and supported at sides of the rib.

* * * * *